US006874715B1

(12) United States Patent
Moen et al.

(10) Patent No.: US 6,874,715 B1
(45) Date of Patent: Apr. 5, 2005

(54) EL TYPE PULVERIZERS

(75) Inventors: Noel S. Moen, Uniontown, OH (US); Andrew E. Jackson, Uniontown, OH (US); Jeffrey C. Pugh, Doylestown, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 478 days.

(21) Appl. No.: 09/698,558

(22) Filed: Oct. 27, 2000

(51) Int. Cl.[7] ..... B02C 15/00

(52) U.S. Cl. ..... 241/103; 241/117

(58) Field of Search ..... 241/103–132

(56) References Cited

U.S. PATENT DOCUMENTS 2,389,844 A * 11/1945 Ebersole ..... 241/47
3,344,998 A * 10/1967 Eft ..... 241/103
3,454,231 A * 7/1969 Engler ..... 241/103
4,049,203 A * 9/1977 McKenzie ..... 241/52

* cited by examiner

*Primary Examiner*—Mark Rosenbaum
(74) *Attorney, Agent, or Firm*—Michael J. Seymour; Eric Marich

(57) ABSTRACT

Improvements in EL type pulverizers provide for longer wear life and reduced incidences of parts failures include: deep-dish contour grinding rings, tight tolerance ball tracks, heavy-duty top grinding ring flukes, larger diameter grinding balls, and an improved all-metal, integral snubber design for limiting the horizontal movement of the top grinding ring in order to increase the useful life of the pulverizer elements.

22 Claims, 4 Drawing Sheets

EL TYPE PULVERIZERS

FIELD AND BACKGROUND OF THE INVENTION

1. Field of the Invention

The present invention relates generally to the field of coal pulverizers and, in particular, EL type pulverizers. More particularly, the present invention is drawn to several new features for EL type pulverizers which, when used either alone or in combination with each other, provide for longer wear life and reduced incidences of parts failures. Briefly, and as described in greater detail in the following description, the present invention includes: deep-dish contour grinding rings, tight tolerance ball tracks, heavy-duty top grinding ring flukes, larger diameter grinding balls, and an improved all-metal snubber design for limiting the horizontal movement of the top grinding ring.

2. Background of the Invention

Coal pulverizers are used to grind, dry and classify raw chunks of coal into fine solids which can be fluidized and fed, for example, to burners used in conjunction with industrial or utility boilers or furnaces. As is known to those skilled in the art, several different types of coal pulverizers, or coal mills, exist today, including one known by the designation "EL".

EL type pulverizers were first produced in the early 1950's. EL type pulverizers are ball-and-ring (or ball-and-race) type pulverizers which employ the ball-bearing principle to grind the coal. This design uses two vertical axis horizontal grinding rings, and a set of balls is placed between the grinding rings. The lower or bottom grinding ring rotates through connection to a rotating, vertical main shaft, while the upper or top grinding ring remains stationary and is spring loaded to create grinding pressure. The coal is ground by contact with the upper and lower grinding rings and balls (collectively, the grinding elements). The lower and upper grinding rings are each provided with a race having a predefined, matching track contour that engages the balls. The force from the upper grinding ring pushes the balls against the coal layer on the lower grinding ring. The grinding rings and the balls are made of abrasion resistant alloys and comprise the major wear parts of the mill. Ground coal is swept from the grinding zone defined by the grinding rings and the balls by air for final particle size classification and subsequent pneumatic transport to one or more coal burners. For further details of such EL type pulverizers, the reader is referred to Chapter 12 of Steam/its generation and use, 40th Edition, Stultz and Kitto, Eds., Copyright ©1992, The Babcock & Wilcox Company, the text of which is hereby incorporated by reference as though fully set forth herein.

EL mill top grinding rings have historically been loaded, and horizontal/rotational movement restricted, by using up to six single coil, dual-purpose springs. In a majority of cases, this design has proven to be an adequate means to restrict movement of the top grinding ring to allow operation without cyclic fatigue failures. However, when a coal with a high Hardgrove Grindability Index (HGI) is encountered, a high turndown is required from the mill, or when the mill is operated with little or no coal feed, the bed of pulverized coal on the lower grinding ring is severely reduced and metal-to-metal contact between the balls and grinding rings occurs. Such contact can cause excessive horizontal movement of the balls and top grinding ring due to undampened centrifugal forces. This excessive horizontal movement can be eccentric to the rotation of the lower grinding ring, resulting in premature wear and possible premature failure of the grinding rings, balls, springs and gearbox main shaft from cyclic metal fatigue.

Furthermore, such undampened centrifugal forces have allowed the balls to partially leave the grinding track established by the top and bottom grinding ring, since the previous design of the top and bottom grinding ring has not provided sufficient dampening forces required to counteract the centrifugal forces. This partial escape of the balls from their rotational track has caused severe chipping of material off the top and bottom grinding ring's outside diameter, uneven wear patterns in the grinding rings, and spalling of metal off the ball surface. Any of these conditions have caused premature replacement of the grinding wear parts in the mill, along with additional internal components that may have failed indirectly as a result of the undampened centrifugal forces, such as the dual-purpose springs, housing units, and the gearbox main shaft.

Previous attempts to limit top grinding ring movement and subsequent failures of internal components include a device known as a snubber that is secured to an existing top grinding ring. Known snubbers are intended only to limit top grinding ring radial movement, and have been either bolted or welded to an existing top grinding ring. These snubbers experience failure because it is not possible to secure the snubber to the hard, high-chrome wear material of the grinding ring. Thus, catastrophic failures of grinding wear parts and other internal components will sometimes result from these attachment failures, in turn causing expensive and premature mill rebuilds and problems with the availability and reliability of the coal pulverizer.

Reliable coal pulverizer performance is essential for sustained full load operation of modern coal-fired electric power generation stations. An effective coal mill must be capable of handling a wide variety of coals and accommodating load swings without failure of internal parts.

SUMMARY OF THE INVENTION

The present invention is drawn to several new features for EL type pulverizers which, when used either alone or in combination with each other, provide for longer wear life and reduced incidences of parts failures. Briefly, these features include: deep-dish contour grinding rings, tight tolerance ball tracks, heavy-duty top grinding ring flukes, larger diameter grinding balls, and an improved all-metal snubber design for limiting the horizontal movement of the top grinding ring.

The stresses that initiate main shaft failure mechanisms in EL pulverizers primarily come from the energy of the several balls which roll along in between the upper and lower grinding rings and also rotate about the vertical axis of the main shaft, and the reaction forces of the spring loaded top grinding ring to the balls. It has been determined that eccentric loadings on the main shaft caused by the movements of these balls is a primary cause of such main shaft failures. Accordingly, the present invention is drawn to several improvements to the grinding rings which are intended to keep the balls in a balanced, circular orbit, thus reducing or eliminating eccentric loadings on the vertical main shaft.

A newly designed ball track, which effectively dampens the centrifugal forces that allow the balls to partially leave their original track, is required to reduce premature failures such as material chipping off the grinding ring OD, uneven wear patterns, and spalling metal off the ball surfaces, along with indirect failures of dual-purpose springs, housing units, and the gearbox main shaft. In particular, the cross-section of the ball track in both the upper and lower grinding rings is machined to a radius slightly larger than the nominal radius of the balls. This difference in radius of the "tight radius ball track" allows some freedom in the ball orbit around the circumference of the ball track, and allows some of the centrifugal force of the rotating balls to translate into ring separation (separation of the balls from one another around the grinding ring) and spring compression. However, the radius differential between the radius of the ball track and the nominal radius of the balls is reduced from that normally provided so that the ball orbit around the circumference of the ball track is more tightly controlled, thereby resulting in less force being translated into spring compression.

A newly designed snubber, which effectively eliminates horizontal and rotational movement of the top grinding ring without failure of the attachment device, is needed to maintain the efficiency of type EL mills. This aspect is accomplished by a system of oscillation snubbers which hold the top grinding ring in horizontal alignment within the pulverizer housing, while still allowing the vertical motion of the spring loading system which provides the grinding forces necessary to grind the coal provided to the pulverizer.

Accordingly, one object of the present invention is to provide a snubber for the top grinding ring of a type EL coal pulverizer which substantially reduces, and preferably eliminates, horizontal and rotational movement in the top grinding ring.

Another object of the present invention is to provide a snubber which will increase the useable wear life of the top grinding ring and other internal components in a type EL coal pulverizer.

Yet another object of the present invention is to provide a top and bottom grinding ring with an improved tolerance "deep dish" ball track contour sufficient to dampen the centrifugal forces that allow the balls to partially leave their original track, thereby reducing damage to, and premature failures of, top and bottom grinding rings, balls, springs, housing units and main shafts.

Yet still another object of the present invention is to provide a top grinding ring with "heavy duty" guide vanes (flutes) sufficient to dampen the centrifugal forces that allow the balls to partially leave their original track, thereby reducing damage to, and premature failures of, top and bottom grinding rings, balls, springs, housing units and main shafts.

Still another object of the present invention is to provide a top and bottom grinding ring with an improved tolerance "deep dish" ball track contour which will increase the useable wear life of the top and bottom-grinding ring and other components in a type EL coal pulverizer when an all-metal snubber is either not required or desired.

A still further object of the present invention is to provide a top grinding ring with "heavy duty" guide vanes (flutes) and a top and bottom grinding ring with an improved tolerance "deep dish" ball track contour, as mentioned above, for reducing damage to, and premature failures of, top and bottom grinding rings, balls, springs, housing units and main shafts when an all-metal snubber is either not required or desired.

Yet still another object of the present invention is to provide a new grinding wear part profile which will increase the useable wear life by means of larger diameter balls with matching grinding ring profiles in a type EL coal pulverizer, and which can be utilized either with or without the all-metal snubber mentioned above.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1:
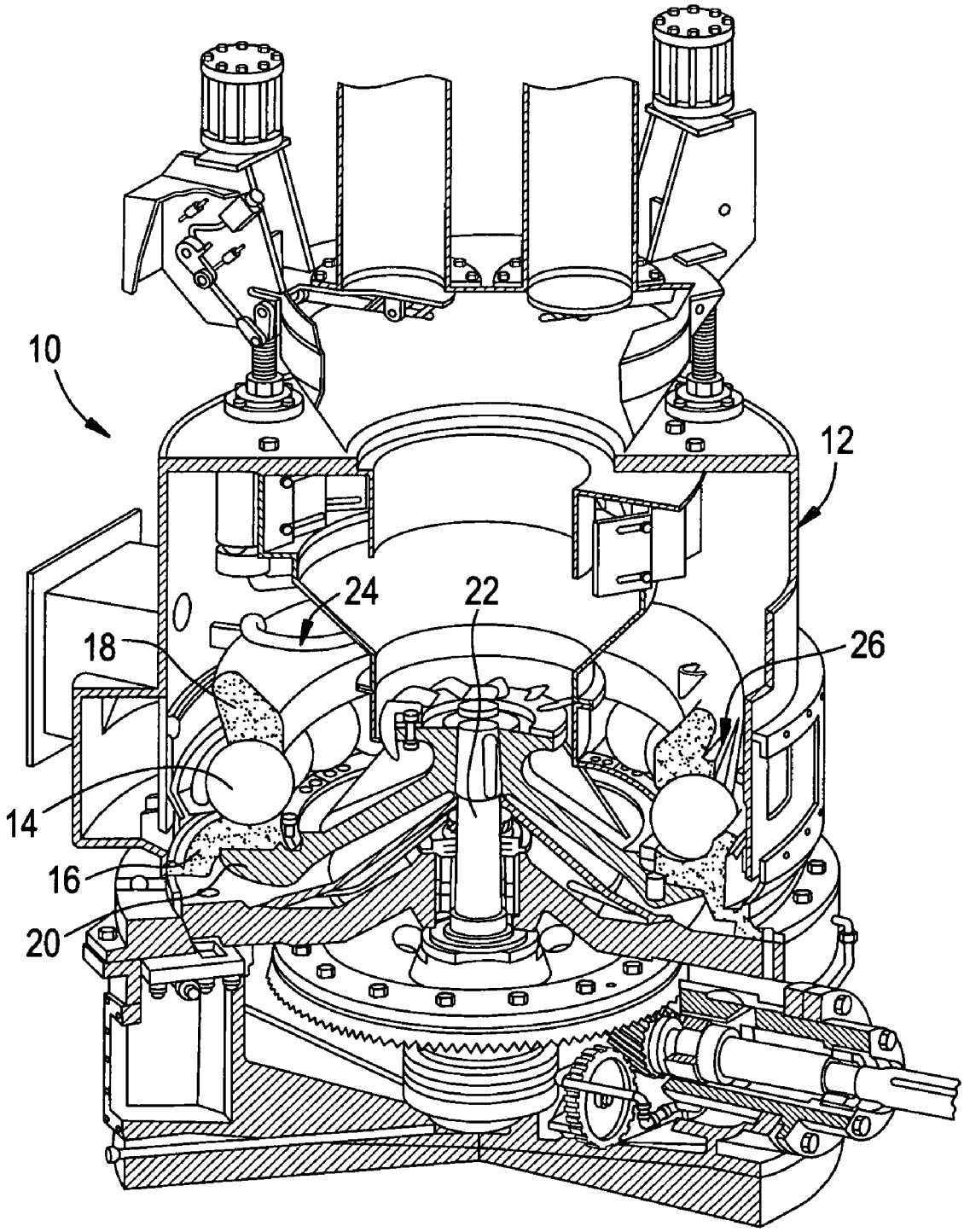
FIG. 1 is a perspective view of a type EL pulverizer.

Referring to the drawings generally, wherein like numerals designate the same or functionally similar elements throughout the several drawings, FIG. 1 shows a perspective view of a type EL pulverizer, generally designated 10, for grinding incoming material such as coal.

Referring to FIG. 1, the grinding or crushing of coal in the type EL pulverizer 10 is conducted within a pulverizer housing 12. The pulverizer housing contains a plurality of pulverizer balls 14, which are resting in a track established between a bottom grinding ring 16 and a top grinding ring 18. The balls 14, bottom grinding ring 16 and top grinding ring 18 comprise the grinding wear parts of a type EL pulverizer 10, and require periodic replacement due to the abrasive nature of the raw coal. The lower grinding ring 16 rests on top of a pulverizer yoke 20, which rotates about a vertical axis established by the gearbox main shaft 22 and yoke 20 of the type EL pulverizer 10. The upper grinding ring 18 is subjected to an external loading force required for grinding the coal by dual-purpose springs 24. These dual-purpose springs 24 are referred to as such because in addition to providing the loading forces required to grind the coal, they also supply the forces required to keep the top grinding ring 18 from experiencing excessive radial movement, circumferential twisting, and eccentric rotation with respect to the lower grinding ring 16.

The outside diameter of the upper grinding ring 18 comprises "flutes" 26, which provide primary circulation of partially ground coal in the grinding wear parts, and which also provide tracking forces to the pulverizer balls 14 to allow concentric rotation and orbiting of the balls 14 in the track of the upper grinding ring 18 and lower grinding ring 16. However, when inadequate dual-purpose spring 24 forces exist, or excessive movement of the top grinding ring 18 is present, or the centrifugal force of the balls 14 is not limited, conditions have proven favorable to cause material to be chipped off the outside diameter (OD) of the top and bottom grinding rings 18 and 16, spalling of material off the surface of balls 14, uneven wear patterns in the top and bottom grinding ring 18 and 16, and indirect failures of the dual-purpose springs 24, flutes 26, and gearbox main shaft 22.

Figure 3:
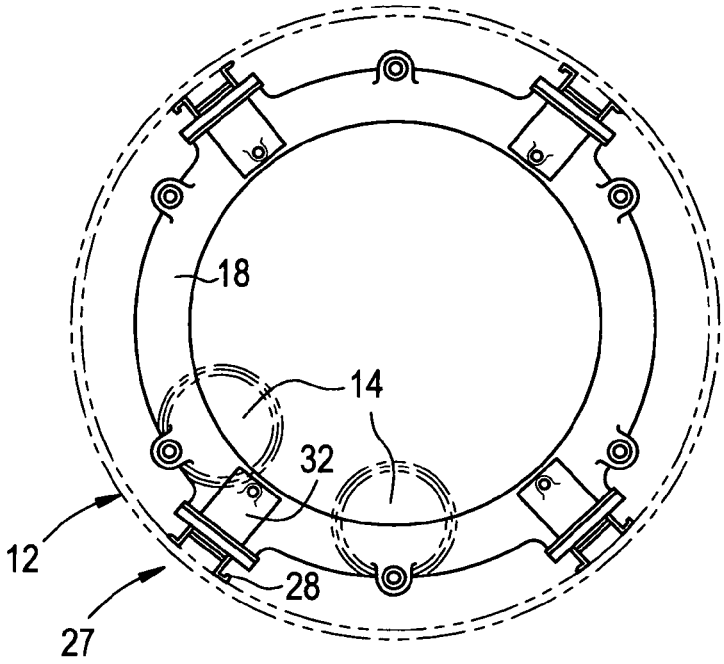
FIG. 3 PRIOR ART
FIG. 3 is a plan view of a portion of FIG. 2 illustrating normal grinding wear parts equipped with previous top grinding ring snubbers.
Figure 2:
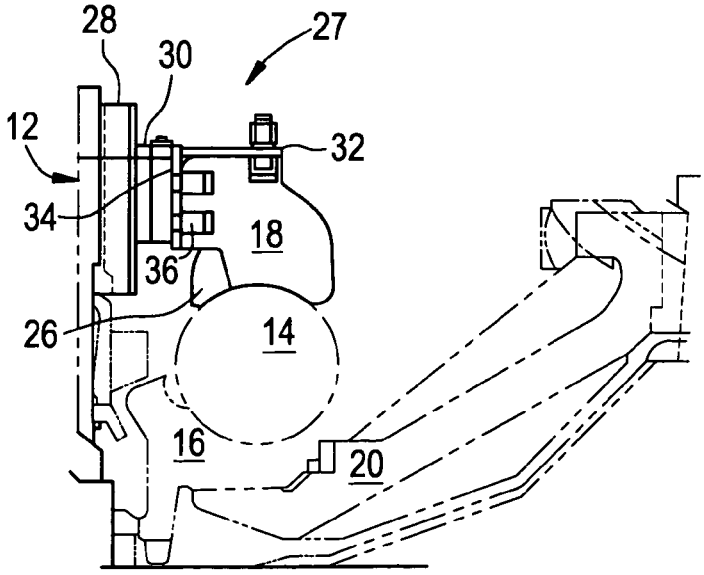
FIG. 2 PRIOR ART
FIG. 2 is a cross-sectional view of type EL pulverizer normal grinding wear parts and snubbers.

FIGS. 2 and 3 illustrate a prior art snubber design which was used to limit radial movement of the top grinding ring 18. These known snubbers, generally referred to as 27, were either bolted or welded to the top grinding ring 18 by means of soft steel inserts 36 embedded into the hard, wear-resistant parent material of the top grinding ring 18. The prior art design included a plurality of snubbers 27, typically four in number, located and equally spaced around the circumference of the pulverizer housing 12. Each snubber 27 comprised a snubber bracket 28 attached to the pulverizer housing 12, a snubber block 30, a snubber frame 32 attached to the existing top grinding ring 18 with necessary fasteners, and a snubber shim pack 34 that allowed the clearance between the snubber block 30 and snubber bracket 28 to be reduced.

As will be seen from FIGS. 2 and 3, there was no means to provide limits to the circumferential rotation of the top grinding ring 18 with the previous snubbers 27, since they were oriented and designed to resist forces along a radial line extending outwardly from the center of rotation of the pulverizer main shaft 22 which drives the bottom grinding ring 16. Furthermore, as the attachment of the snubber frame 32 to the top grinding ring 18 proved failure-prone, and as the radial gap between the snubber block 30 and snubber bracket 28 increased from wear, the contact force between the top grinding ring 18, snubber frame 32, and snubber bracket 28 became excessive. This resulted in premature failure of these and other internal parts, requiring expensive and premature mill rebuilds and problems with the availability and reliability of the coal pulverizer 10.

Figure 5:
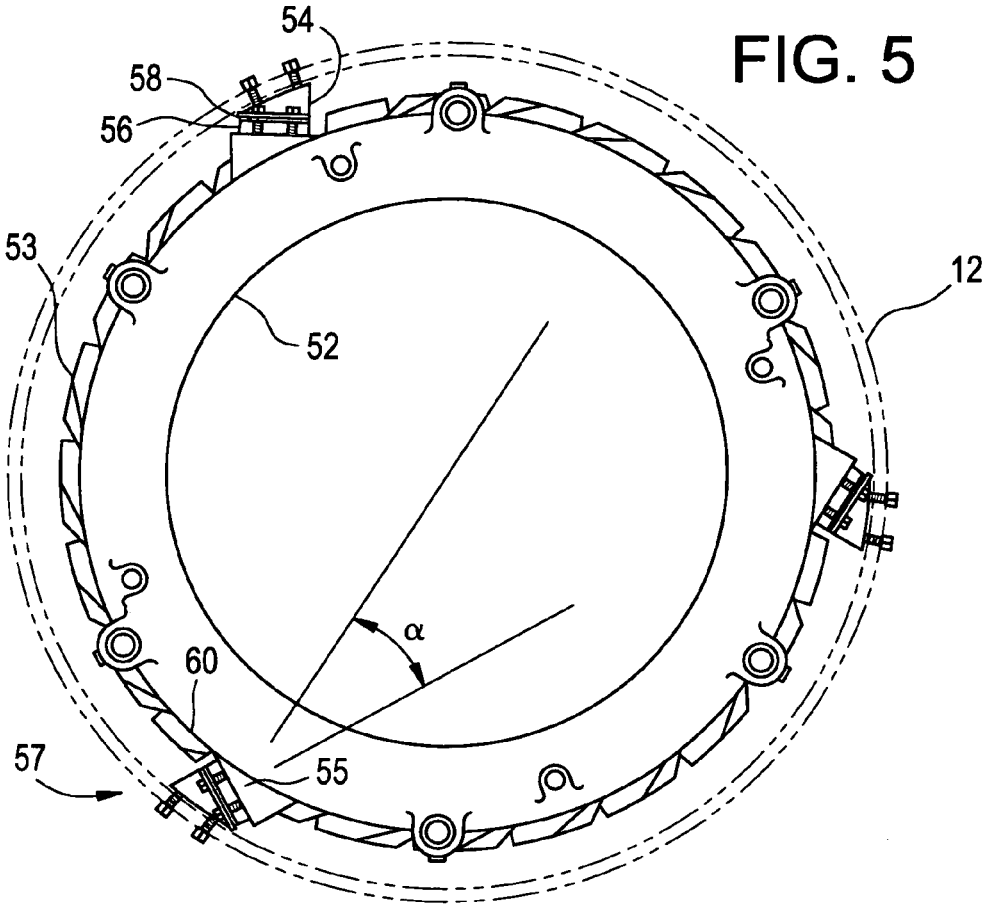
FIG. 5 is a plan view of a portion of FIG. 4 illustrating grinding wear parts equipped with all-metal snubbers according to the present invention.
Figure 4:
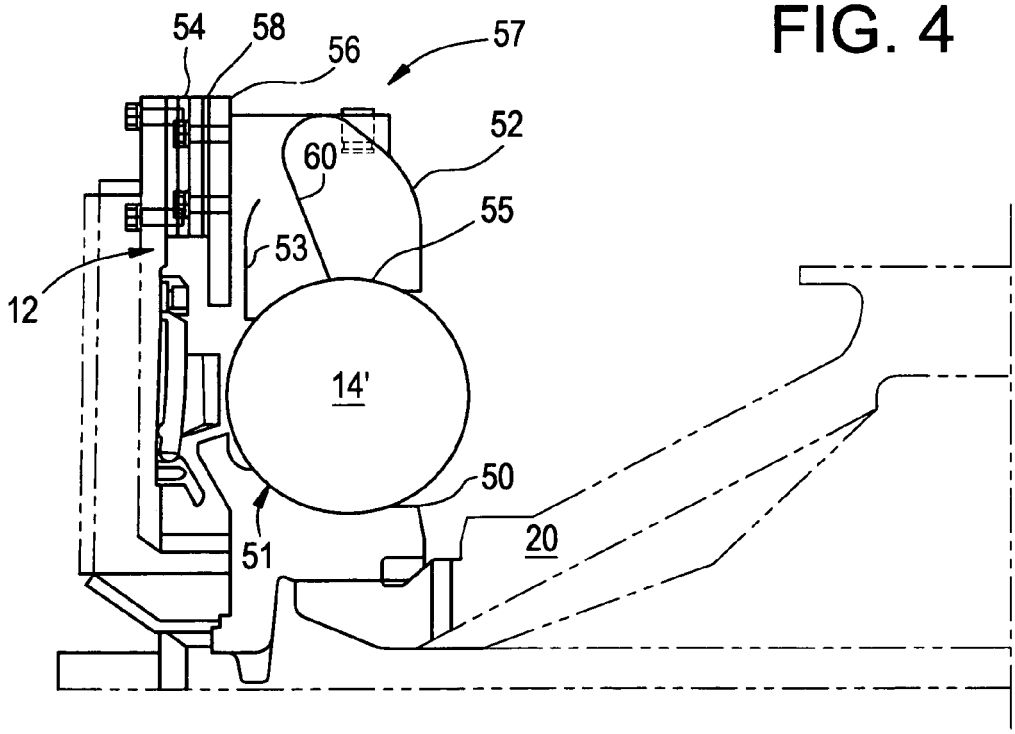
FIG. 4 is a cross-sectional view of grinding wear parts equipped with all-metal snubbers according to the present invention.

Referring now to FIGS. 4 and 5, and according to the present invention, several improvements will be seen in the design and arrangement of the pulverizer grinding elements or wear parts. First, there is provided a new design and configuration of the bottom grinding ring, generally referred to as 50, which is provided with an improved tolerance "deep dish" ball track contour 51. Next, there is provided a new design and configuration of the top grinding ring, generally referred to as 52, having "heavy duty" guide vanes (flutes) 53 and which is also provided with an improved tolerance "deep dish" ball track contour 51. Finally, there is provided a new design and configuration of an all-metal snubber, generally referred to as 57, which is preferably formed or cast as part of the parent material of the improved top grinding ring casting 52 as a contour change on an outer edge thereof, i.e., as an integral part. As illustrated in FIG. 5, a plurality of such OD contour changes 55 inherent to the parent casting are provided; the number of snubbers 57 is typically three in number, equally spaced around the circumference of the top grinding ring 52, as opposed to the four snubbers 27 of the prior art. If required, additional snubbers 57 may be provided, again equally spaced around the circumference of the top grinding ring 52.

To attach the integral snubber 57 to the pulverizer housing 12, a matching number of snubber brackets 54 are provided which attach to the pulverizer housing 12 and which match the orientation of the integral snubbers 57 formed as contour changes 55 in the improved top grinding ring 52. Snubber wear plates 56 and shim packs 58, adapted to the new design configuration of the integral snubber 57, are also provided as means for adjusting or eliminating clearance therebetween as required during field installation.

The "heavy duty" guide vanes (flutes) 53 of the top grinding ring 52 extend downwardly and outwardly at an outer edge 60 of the top grinding ring 52, and to a greater degree than the flutes of the prior art. The "heavy duty" flutes 53 are also of substantial circumferential width, measured along the outer edge 60 of the top grinding ring 52, such that the total circumferential length of all heavy duty flutes 53 exhibit an arcuate length of at least 50% of the total available circumference at the outer edge of the top grinding ring 52, thereby permitting the top grinding ring 52 to better withstand the excessive centrifugal forces produced by the pulverizer balls 14. More particularly, a preferred embodiment of the top grinding ring 52 having a continuous arcuate grinding track formed on a bottom surface of the top grinding ring is designed so that the continuous arcuate grinding track has an arcuate length that is at least 29% of the circumference of one pulverizer ball of the plurality of balls. Similarly, a preferred embodiment of the bottom grinding ring 50 having a continuous arcuate grinding track formed on a top surface of the bottom grinding ring is designed so that the continuous arcuate grinding track has an arcuate length that is at least 23% of the circumference of one pulverizer ball of the plurality of balls. Of course, the particular arcuate length is that which is sufficient to keep the pulverizer balls 14, 14' contained therein during operation of the pulverizer 10 without experiencing the detrimental effects described earlier. In some cases, sufficient spring forces or smaller diameter pulverizer balls 14 will permit shorter arcuate lengths, while in other cases longer arcuate lengths will be required for satisfactory performance.

In addition, there is provided an improved circular tolerance of the ball track made up of the top grinding ring 52 and bottom grinding ring 50. By increasing the accuracy of this resulting ball track, eccentric rotation of the balls 14' in the intended ball track is prohibited. In particular, the continuous arcuate grinding track formed on a bottom surface of the top grinding ring, and the top surface of the bottom grinding ring, has a diameter which is held to a circular tolerance within ±1/16" of its ultimate concentricity.

To further enhance "capture" and retention of the pulverizer balls 14' during operation of the pulverizer 10 within the confines of the ball track established by the top and bottom grinding rings, 52, 50, a combined "deep dish" contour 51 of the ball track made up of the top grinding ring 52 and bottom grinding ring 50 is provided and preferably sized with an arcuate length which is at least 52% of the total available ball 14' circumference. More particularly, the continuous arcuate grinding track formed on a bottom surface of the top grinding ring, and the top surface of the bottom grinding ring, has an arcuate length which is held to circular tolerance within ±1/16" of its ultimate curvature.

The contact angle $\propto$ between the snubber bracket 54 and top grinding ring 52 with inherent contour changes 55 is oriented between a radial orientation with respect to the top grinding ring 52 outer edge 60 and tangential to the top grinding ring 52 outer edge 60. Preferably, the angle $\propto$ is within a range of approximately 15 degrees to approximately 65 degrees, and preferably 28 degrees. Various factors can affect the particular value selected for angle $\propto$, including the particular size of mill, the available clearance between internal parts and the pulverizer housing 12, the physical installation requirements, etc. In a functional sense, the value for angle $\propto$ is also dependent upon the degree to which radial or twisting/tangential forces will be experienced by the top grinding ring 52; factors such as spring sizes and rates can vary the amount of downforce applied to the top grinding ring 52, as well as the degree of resistance those springs provide to radial and/or twisting forces. If a greater resistance to radial forces is desired, angle ∝ might be selected towards the lower end of the range; if a greater resistance to tangential or twisting forces is desired, the value for angle ∝ may be selected towards the upper end of the range. In any event, angle ∝ is selected to provide the greatest amount of wedging action between the snubber wear plate 56 and the top grinding ring outer edge 60 and provide both radial and circumferential movement restriction of the top grinding ring 52. This reduces forces that cause premature failure of the grinding wear parts and other internal parts. This reduction in premature failure provides longer wear life to each of the grinding wear parts and other internal parts, and substantially reduces the maintenance cost and service time required to maintain the type EL pulverizer 10 in good working condition, which improves availability and reliability of the type EL pulverizer 10.

As mentioned earlier, improved service and wear life of the type EL pulverizer 10 is also provided by utilizing pulverizer balls 14' having a larger diameter than standard. In the prior art type EL pulverizer designs, pulverizer balls 14 having a nominal OD of 12¼ inches are utilized. According to the present invention, larger diameter pulverizer balls 14' having a nominal OD of 13⅝ inches can utilized, taking maximum advantage of the improved "deep dish" ball track contour 51. By virtue of this larger OD, the number of pulverizer balls 14' employed in the type EL pulverizer 10 may be reduced, for example from 17 to 15 in number. However, it is understood that the 12¼ inch diameter balls may also be used with the "deep dish" ball track contours 51, 55 and/or the improved snubber design of the present invention.

Figure 6B:
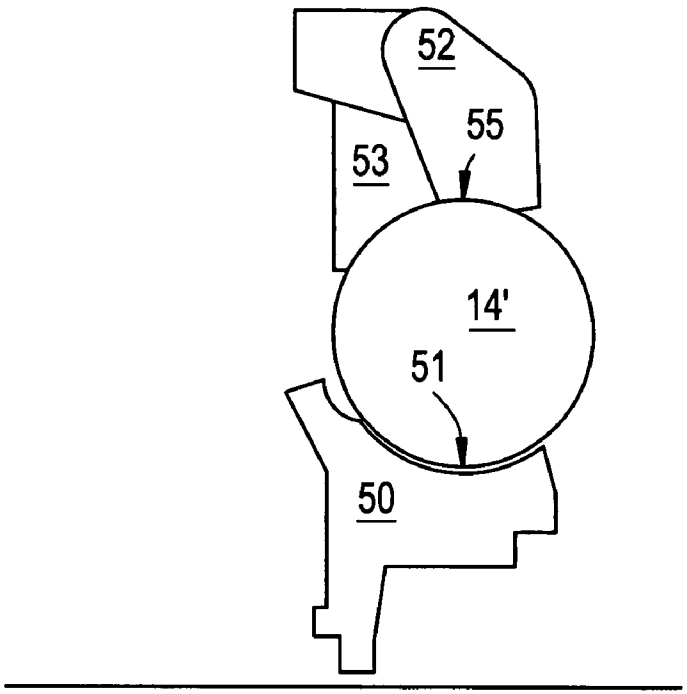
FIGS. 6A and 6B are cross-sectional views illustrating and comparing standard grinding wear parts (FIG. 6A), and grinding wear parts equipped with deep-dish contour grinding rings and heavy-duty top grinding ring flutes according to the present invention (FIG. 6B).
Figure 6A:
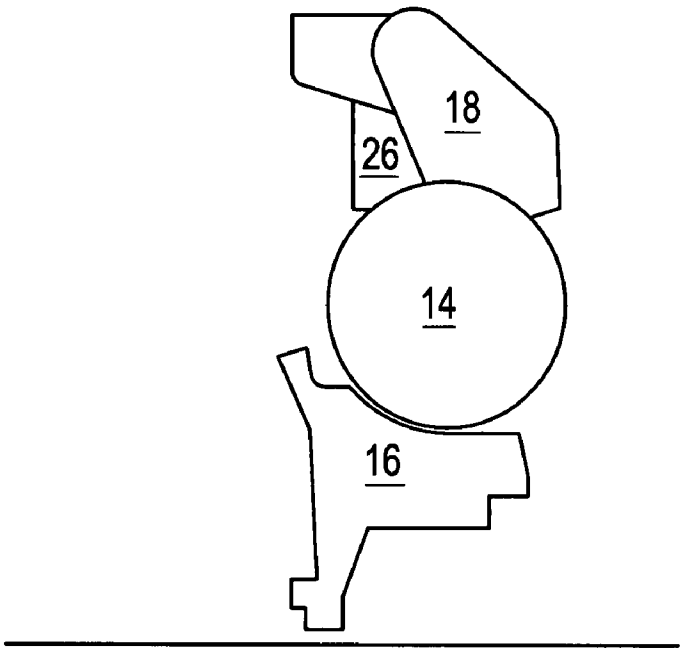
FIG. 6A PRIOR ART

Referring to FIGS. 6A and 6B, there is shown a comparison of standard grinding wear parts versus the improved features of the present invention, which include grinding wear parts with larger diameter balls 14', bottom grinding ring 50 with improved tolerance "deep dish" ball track contour 51, and top grinding ring 52 with improved tolerance "deep dish" ball track contour 55 and "heavy-duty" flutes 53. These improved life grinding wear parts can also be fitted with the new all-metal snubber 57 if so desired or required.

While specific embodiments of the invention have been shown and described in detail to illustrate the application of the principles of the invention, it will be understood that the invention may be embodied otherwise without departing from such principles. For example, the present invention may be applied in new construction involving type EL pulverizers, or to the repair, replacement or modification of existing type EL pulverizers. Certain features of the invention may be used to advantage without a corresponding use of the other features, such as employing the "deep dish" contour with or without the improved snubber design, or with standard sized pulverizer balls as well as with the larger diameter pulverizer balls.

We claim:

1. A top grinding ring for an EL type pulverizer comprising at least one integral snubber casted as part of the parent material of the top grinding ring and formed as a contour change on an outer edge of the top grinding ring, and a plurality of equally spaced apart flutes extending downwardly from the outer edge of the top grinding ring.

2. The top grinding ring according to claim 1, wherein a integral snubber is oriented at an angle ∝ with respect to a radial line originating at a center of the grinding ring, angle ∝ having a value within a range of approximately 15 degrees to approximately 65 degrees.

3. The top grinding ring according to claim 2, wherein angle ∝ has a value of approximately 28 degrees.

4. The top grinding ring according to claim 1, further comprising a continuous arcuate grinding track formed on a bottom surface of the top grinding ring and adapted to receive a plurality of pulverizer balls each having an OD and circumference which roll against the arcuate grinding track.

5. The top grinding ring according to claim 4, wherein the continuous arcuate grinding track has a diameter which is held to a circular tolerance within ±1/16 inches of its ultimate concentricity.

6. The top grinding ring according to claim 4, wherein the continuous arcuate grinding track has an arcuate length that is at least 29% of the circumference of one of the plurality of pulverizer balls.

7. The top grinding ring according to claim 6, wherein the continuous arcuate grinding track has an arcuate length which is held to a circular tolerance within ±1/16 inches of its ultimate curvature.

8. The top grinding ring according to claim 1 wherein the total circumferential length of all the equally spaced apart flutes exhibits an arcuate length of at least 50% of the total available circumference at the outer edge of the top grinding ring.

9. The top grinding ring according to claim 1, comprising a plurality of integral snubbers, each of the integral snubbers being equally spaced around a circumference of the top grinding ring.

10. An EL type pulverizer, comprising: a housing, a top grinding ring having a continuous arcuate grinding track formed on a bottom surface of the top grinding ring and adapted to receive a plurality of pulverizer balls each having an OD and circumference, and at least one integral snubber casted as part of the parent material of the top grinding ring and formed on an outer edge of the top grinding ring, snubber attachment means attached to the housing for securing the integral snubber to the housing, and a plurality of equally spaced apart flutes extending downwardly from the outer edge of the top grinding ring.

11. The pulverizer according to claim 10, wherein the snubber attachment means comprises a snubber bracket assembly including a snubber bracket secured to the pulverizer housing, a wear plate secured to the integral snubber, and a shim pack therebetween for adjusting a clearance between the snubber wear plate and the snubber bracket.

12. The pulverizer according to claim 11, wherein the snubber attachment means is removably secured to the pulverizer housing and to a integral snubber to permit the snubber attachment means to be installed and dismantled from the pulverizer housing subsequent to top grinding ring installation and removal, the shim pack providing means to adjust or eliminate the clearance between the snubber wear plate and the snubber bracket.

13. The pulverizer according to claim 10, comprising a bottom grinding ring having a continuous arcuate grinding track formed on a top surface of the bottom grinding ring and adapted to receive a plurality of pulverizer balls each having an OD and circumference which roll against the continuous arcuate grinding track, the bottom grinding ring having an arcuate length that is at least 23% of the total circumference of one of the plurality of pulverizer balls.

14. The pulverizer according to claim 13, wherein the continuous arcuate grinding track formed on the top surface of the bottom grinding ring has a diameter which is held to a circular tolerance within 1/16 inches of its ultimate concentricity.

15. The pulverizer according to claim 13, wherein the continuous arcuate grinding track formed on a top surface of the bottom grinding ring has an arcuate length which is held to a circular tolerance within ±1/16 inches of its ultimate curvature.

16. The pulverizer according to claim 10, wherein each of the plurality of pulverizer balls has a nominal OD of one of 12 1/14 inches and 13 5/8 inches when in a new condition and first installed in the pulverizer.

17. A top grinding ring for an EL type pulverizer comprising a plurality of equally spaced apart flutes extending downwardly from an outer edge of the top grinding ring, a continuous arcuate grinding track formed on a bottom surface of the top grinding ring and adapted to receive a plurality of pulverizer balls each having an OD and circumference which roll against the arcuate track, wherein the continuous arcuate grinding track has an arcuate length that is at least 29% of the circumference of one of the plurality of pulverizer balls.

18. The top grinding ring according to claim 17, wherein the continuous arcuate grinding track has a diameter which is held to a circular tolerance within ±1/16 inches of its ultimate concentricity.

19. The top grinding ring according to claim 17, wherein the continuous arcuate grinding track has an arcuate length which is held to a circular tolerance within ±1/16 inches of its ultimate curvature.

20. An EL type pulverizer comprising a top and a bottom grinding ring, a continuous arcuate grinding track formed on a top surface of the bottom grinding ring and adapted to receive a plurality of pulverizer balls each having an OD and circumference which roll against the arcuate grinding track, wherein the grinding track has an arcuate length that is at least 23% of the circumference of one of the plurality of pulverizer balls, and a plurality of spaced apart flutes extending downwardly from an outer edge of the top grinding ring.

21. The pulverizer according to claim 20, wherein the continuous arcuate grinding track has a diameter which is held to a circular tolerance within ±1/16 inches of its ultimate concentricity.

22. The pulverizer according to claim 20, wherein the continuous arcuate grinding track has an arcuate length which is held to a circular tolerance within ±1/16 inches of its ultimate curvature.

* * * * *